US005606761A

United States Patent [19]

Lynch

[11] Patent Number: 5,606,761

[45] Date of Patent: Mar. 4, 1997

[54] TELESCOPIC SCRAPER TOOL

[76] Inventor: William D. Lynch, 415 Marlborough Rd., Brooklyn, N.Y. 11226-5617

[21] Appl. No.: 546,817

[22] Filed: Oct. 23, 1995

[51] Int. Cl.[6] ..... A47L 13/022

[52] U.S. Cl. ..... 15/144.4; 15/235.8; 15/236.01; 15/236.05; 30/169

[58] Field of Search ..... 15/236.01, 144.4, 15/144.3, 236.04, 236.05, 235.8; 30/169; 248/173, 188.5, 188.7; 403/91

[56] References Cited

U.S. PATENT DOCUMENTS

| | | | |
|---|---|---|---|
| 1,376,995 | 5/1921 | Balsley | 15/236.07 |
| 2,236,365 | 3/1941 | Clark | 15/235.8 |
| 2,535,253 | 12/1950 | Anderson | 15/236.01 |
| 2,896,239 | 7/1959 | Bugbird | 15/236.04 |
| 2,917,104 | 12/1959 | Cottle | 248/188.5 |
| 3,069,713 | 12/1962 | Obraske | 15/236.01 |
| 3,091,790 | 6/1963 | Schroeder | 15/144.4 |
| 4,329,755 | 5/1982 | Alissandratos | 15/144.4 |
| 4,524,484 | 6/1985 | Graham | 15/144.4 |
| 5,319,821 | 6/1994 | Nicholson et al. | 15/144.4 |
| 5,464,481 | 11/1995 | Lietz, Jr. et al. | 15/144.4 |

*Primary Examiner*—David Scherbel
*Assistant Examiner*—James F. Hook

[57] ABSTRACT

A telescopic scraper tool including a first handle. The first handle has a first upper end with a threaded projection and a first lower end. Also included is a second handle. The second handle has a second upper end that is threaded and has a rounded end that is closed. The second upper end has an aperture therethrough for slidable receipt of the first handle therein. A coupling nut is provided. The coupling nut is capable of slidable receipt of the first handle therethrough. The nut has a top end with an overhang for capturing a ring therein. The nut has a bottom end with an exterior surface area therebetween. Lastly, a scrapper component that has a support handle with a triangular portion is included. The triangular portion has a blade edge. The support handle is coupled to the first handle when the first handle is secured within the second handle by the nut. The blade edge of the triangular portion is capable of scraping a surface above and below the arm reach of a user.

1 Claim, 3 Drawing Sheets

TELESCOPIC SCRAPER TOOL

BACKGROUND OF THE INVENTION

1. Field of the Invention

The present invention relates to a telescopic scraper tool and more particularly pertains to providing an adjustable handle that can increase and decrease the reach of a scrapper blade and is further capable of accommodating scraper blades of various widths.

2. Description of the Prior Art

The use of a scrapper tool is known in the prior art. More specifically, a scrapper tool heretofore devised and utilized for the purpose of scrapping surfaces is known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,337,442 to Stewart discloses a scrapper apparatus. U.S. Pat. No. 5,165,144 to Nisenbaum discloses a tool handle and angularly adjustable attachment. U.S. Pat. No. 4,517,700 to Pinto discloses an adjustable scrapper tool. U.S. Pat. No. 3,562,826 to Vaughn discloses a multiple purpose scrapping tool. Lastly, U.S. Pat. No. 338,822 to Mallaliem discloses a scrapper handle.

While these devices fulfill their respective, particular objectives and requirements, the aforementioned patents do not describe telescopic scraper tool that allows a user to reduce back strain through the use of the tool when the height of the scrapper is adjusted by sliding the first handle up and down within the second handle and locking the handles in position with the scrapper blade attached thereto.

In this respect, the telescopic scraper tool according to the present invention substantially departs from the conventional concepts and designs of the prior art, and in doing so provides an apparatus primarily developed for the purpose of providing an adjustable handle that can increase an decrease the reach of a scrapper blade and is further capable of accommodating scraper blades of various widths.

Therefore, it can be appreciated that there exists a continuing need for a new and improved telescopic scraper tool which can be used for providing an adjustable handle that can increase an decrease the reach of a scrapper blade and is further capable of accommodating scraper blades of various widths. In this regard, the present invention substantially fulfills this need.

SUMMARY OF THE INVENTION

In view of the foregoing disadvantages inherent in the known types of a scrapper tool now present in the prior art, the present invention provides an improved telescopic scraper tool. As such, the general purpose of the present invention, which will be described subsequently in greater detail, is to provide a new and improved telescopic scraper tool and method which has all the advantages of the prior art and none of the disadvantages.

To attain this, the present invention essentially comprises a first cylindrical handle. The handle has a first upper end with a threaded projection and a first lower end. The threaded projection has a diameter of five-eight inch. The first handle has a diameter of one inch and a length of about twenty-four and one half inches including the threaded projection. The threaded projection is cylindrical in shape and has a length of about of 6.5 percent of the length of the handle. Also, a second cylindrical handle is included. The second cylindrical handle has a second upper end that is threaded and a rounded second end that is closed. The second upper end has an aperture therethrough. The second handle has a diameter of about one and one-fourth inch for slidable receipt of the first handle therein. The second handle has a length of about twenty-three and one-fourth inches. The second cylindrical handle is capable of receiving ninety-five percent of the length of the first handle to form a telescopic handle. The telescopic handle has an increasing and decreasing length of about between two to four feet. A cylindrical coupling nut is provided. The nut has a top end and a bottom end with an exterior surface area therebetween. The top end has an overhang for capturing of a ring therein. The surface area has a plurality of rectangular raised portions covering a circumference of the surface area. The raised portions are capable of increasing the gripping friction between fingers and the nut. The nut is in slidable receipt of the first handle. The nut is capable of threadable coupling with the second upper end of the second handle when the first handle is positioned within the second handle. The second upper end rests upon the ring of the nut when the nut locks the telescopic handle. Additionally, a scrapper component is included. The scraper component has a cylindrical support handle with a triangular portion having a blade edge. The scraper component has a length of about eight inches, with the triangular portion being sixty percent of the length. The triangular portion has a blade width that is between two to five inches. The blade edge is rigid for scraping a surface above the arm reach of a user. The blade edge also is for scrapping a surface below the arm reach of the user. Lastly, the support handle has a decreasing exterior diameter that decreases from a back end to the triangular portion. The support handle has an internal threaded portion. The support handle has a length of about two inches with an internal threaded portion coupling with the threaded projection of the first upper end of the first handle. The support handle is coupled to the first handle when the first handle is secured within the second handle by the coupling nut.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved telescopic scraper tool which has all of the advantages of the prior art a scrapper tool and none of the disadvantages.

It is another object of the present invention to provide a new and improved telescopic scraper tool which may be easily and efficiently manufactured and marketed.

It is further object of the present invention to provide a new and improved telescopic scraper tool which is of durable and reliable constructions.

An even further object of the present invention is to provide a new and improved telescopic scraper tool which is susceptible of a low cost of manufacture with regard to both materials and labor, and which accordingly is then susceptible of low prices of sale to the consuming public, thereby making such telescopic scraper tool economically available to the buying public.

Still yet another object of the present invention is to provide a new and improved telescopic scraper tool which provides in the apparatuses and methods of the prior art some of the advantages thereof, while simultaneously overcoming some of the disadvantages normally associated therewith.

Even still another object of the present invention is to provide a telescopic scraper tool for providing an adjustable handle that can increase an decrease the reach of a scrapper blade and is further capable of accommodating scraper blades of various widths.

Lastly, it is an object of the present invention to provide a new and improved telescopic scraper tool including a first handle. The first handle has a first upper end with a threaded projection and a first lower end. Also included is a second handle. The second handle has a second upper end that is threaded and has a rounded end that is closed. The second upper end has an aperture therethrough for slidable receipt of the first handle therein. A coupling nut is provided. The coupling nut is capable of slidable receipt of the first handle therethrough. The nut has a top end with an overhang for capturing a ring therein. The nut has a bottom end with an exterior surface area therebetween. Lastly, a scrapper component that has a support handle with a triangular portion is included. The triangular portion has a blade edge. The support handle is coupled to the first handle when the first handle is secured within the second handle by the nut. The blade edge of the triangular portion is capable of scraping a surface above and below the arm reach of a user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
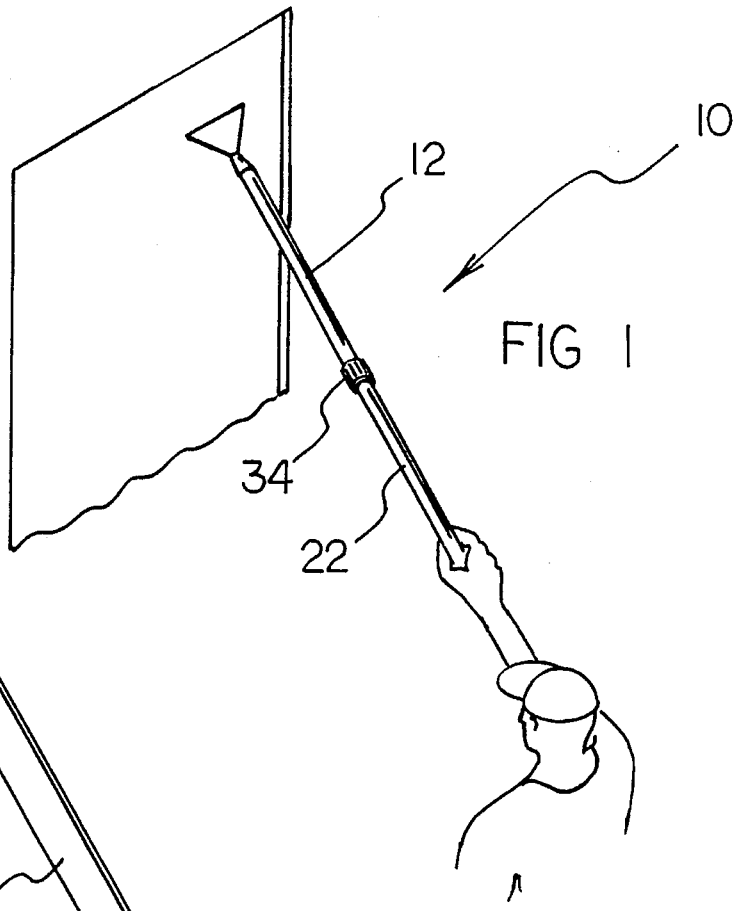
FIG. 1 is a perspective view of the preferred embodiment of the telescopic scraper tool constructed in accordance with the principles of the present invention.

With reference now to the drawings, and in particular to FIG. 1 thereof, the preferred embodiment of the new and improved telescopic scraper tool embodying the principles and concepts of the present invention and generally designated by the reference numeral 10 will be described.

The present invention, the telescopic scraper tool 10 is comprised of a plurality of components. Such components in their broadest context include a first handle, a second handle, a nut, and a scrapper component. Such components are individually configured and correlated with respect to each other so as to attain the desired objective.

Specifically, the present invention includes a first cylindrical handle 12 that has a first upper end 14 with a threaded projection 16 and a first lower end 18. The threaded projection has a diameter of five-eight inch. The first handle has a diameter of one inch and a length of about twenty-four inches. The length of the first handle includes the threaded projection. The threaded projection is cylindrical in shape and has a length of about of 6.5 percent of the length of the handle. The handle of FIG. 1 is formed of metal, plastic, or wood. The projection is integral the first handle and formed of an identical material. The preferred material is metal because of its durability and strength.

Figure 2:
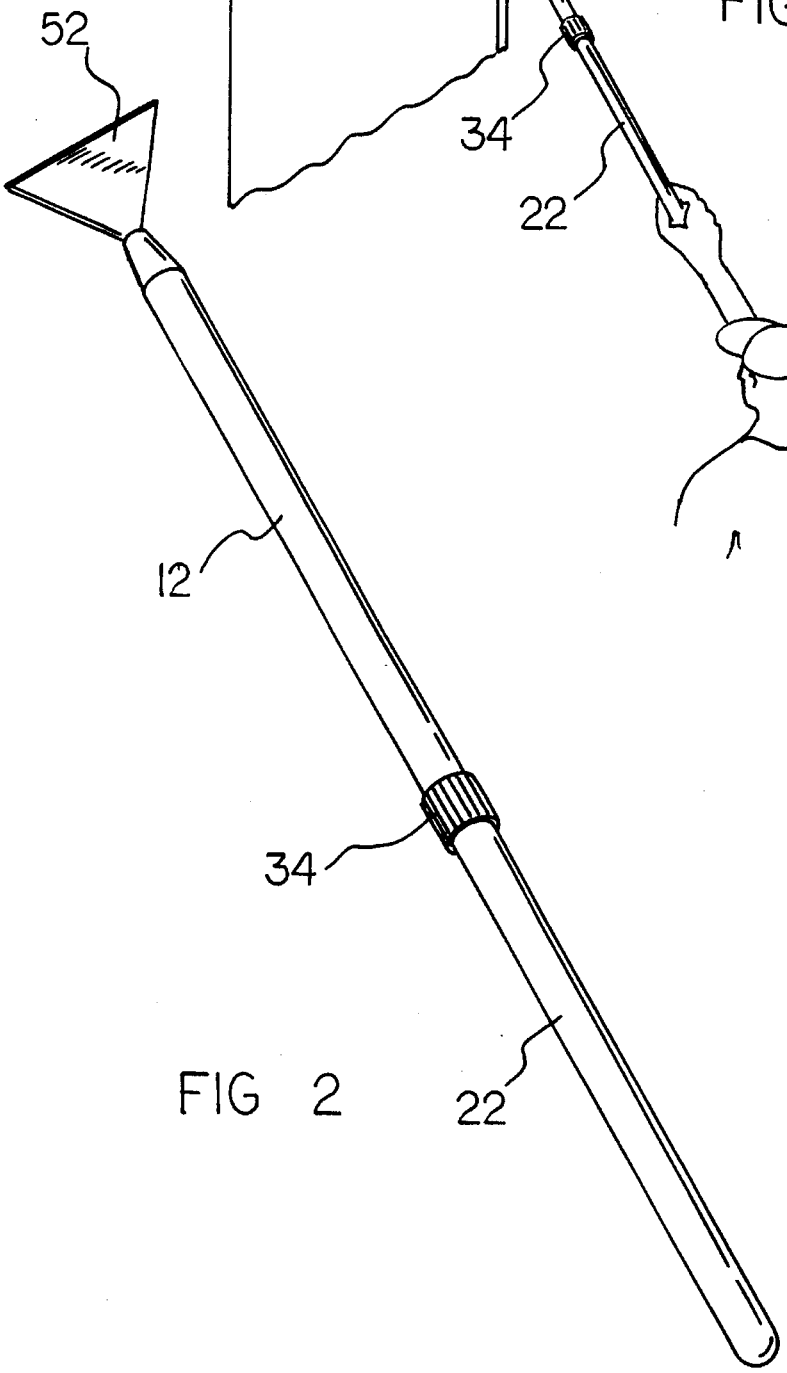
FIG. 2 is an isometric view of the present invention in an operable configuration.
Figure 3:
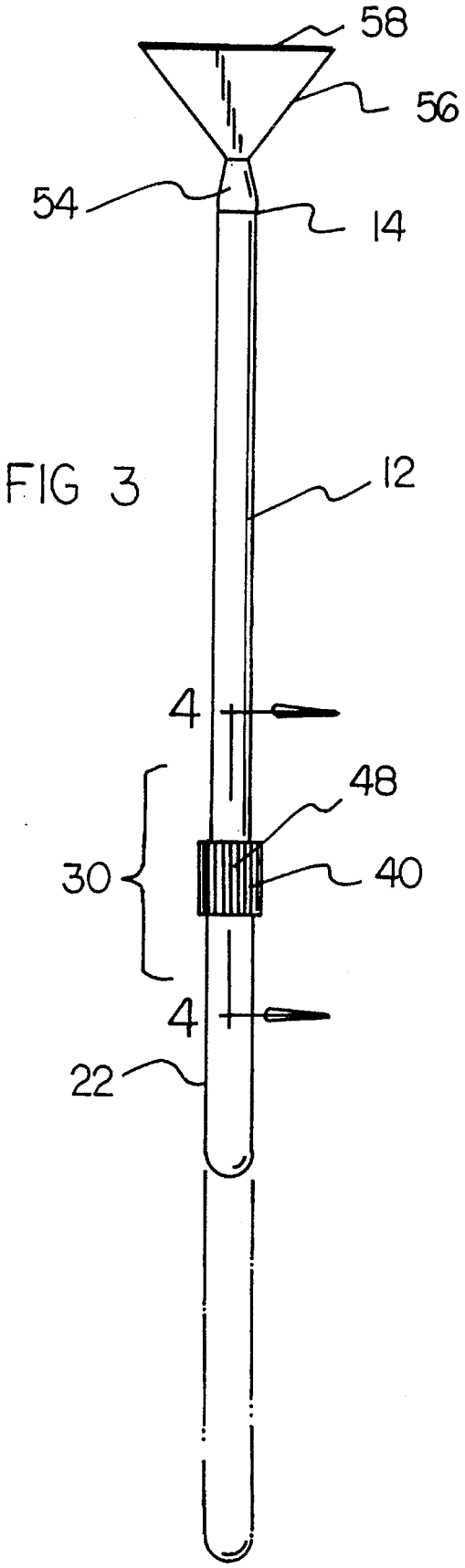
FIG. 3 is a front elevation view of the present invention according to the first embodiment thereof.

As illustrated in FIG. 2, a second cylindrical handle 22 is provided. The second handle has a second upper end 24 that is threaded and has a rounded second end 26 that is closed. The second upper end has an aperture therein. The aperture extends to the second rounded end. The second handle has a diameter of about one and one-fourth inch for slidable receipt of the first handle 12 therein. The second handle has a length of about twenty-three and one-fourth inches. The second cylindrical handle is capable of receiving ninety-five percent of the length of the first handle to form a telescopic handle 30. As shown in FIG. 3, the telescopic handle has an increasing and decreasing length of about between two to four feet. The second handle is formed of the same material that is used to form the first handle.

Figure 4:
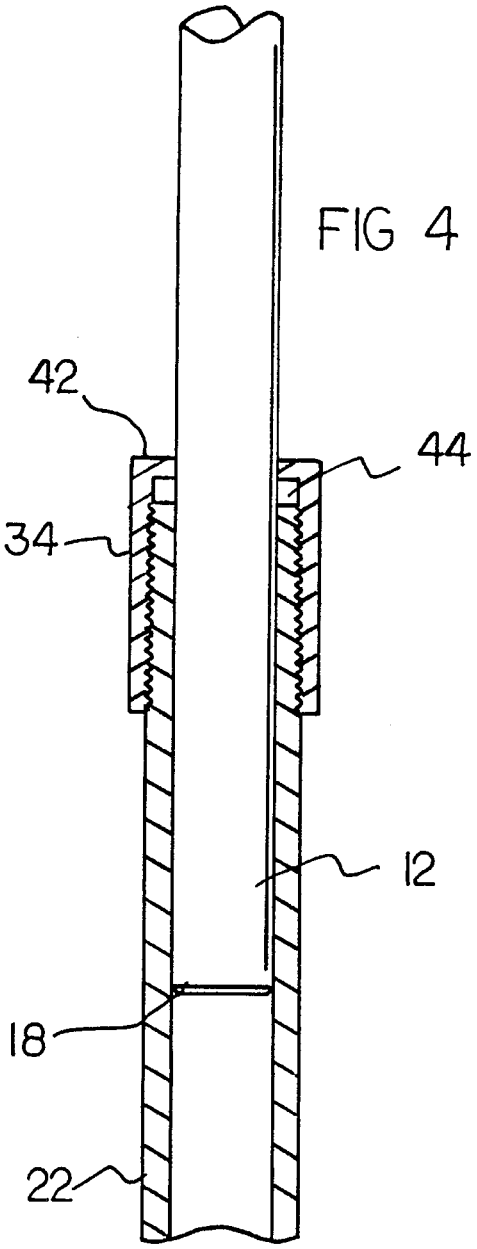
FIG. 4 is a cross sectional view of the present invention taken along line 4—4 of FIG. 3.

Additionally, a cylindrical coupling nut 34 is provided. The nut has a top end 36 and a bottom end 38 with an exterior surface area 40 therebetween. The coupling nut is formed of metal. The top end has an overhang 42 for capturing of a ring 44 therein. The ring is formed of a rigid plastic. The surface area has a plurality of rectangular raised portions 48 covering a circumference of the surface area. The raised portions are capable of increasing the gripping friction between fingers and the nut. Increased friction allows the user to rotate the coupling nut clockwise and counter-clockwise for placement and removal. The nut is capable of slidable receipt of the first handle 12 therethrough. As best illustrated in FIG. 4, the nut is capable of threadable coupling with the second upper end 24 of the second handle 22 when the first handle 12 is positioned within the second handle. Also, as shown in FIG. 4, the second upper end rests upon the ring 44 of the nut when the first handle is positioned therein. The nut locks the two handles when the telescopic handle is formed and maintains the position of the telescopic handle.

Figure 5:
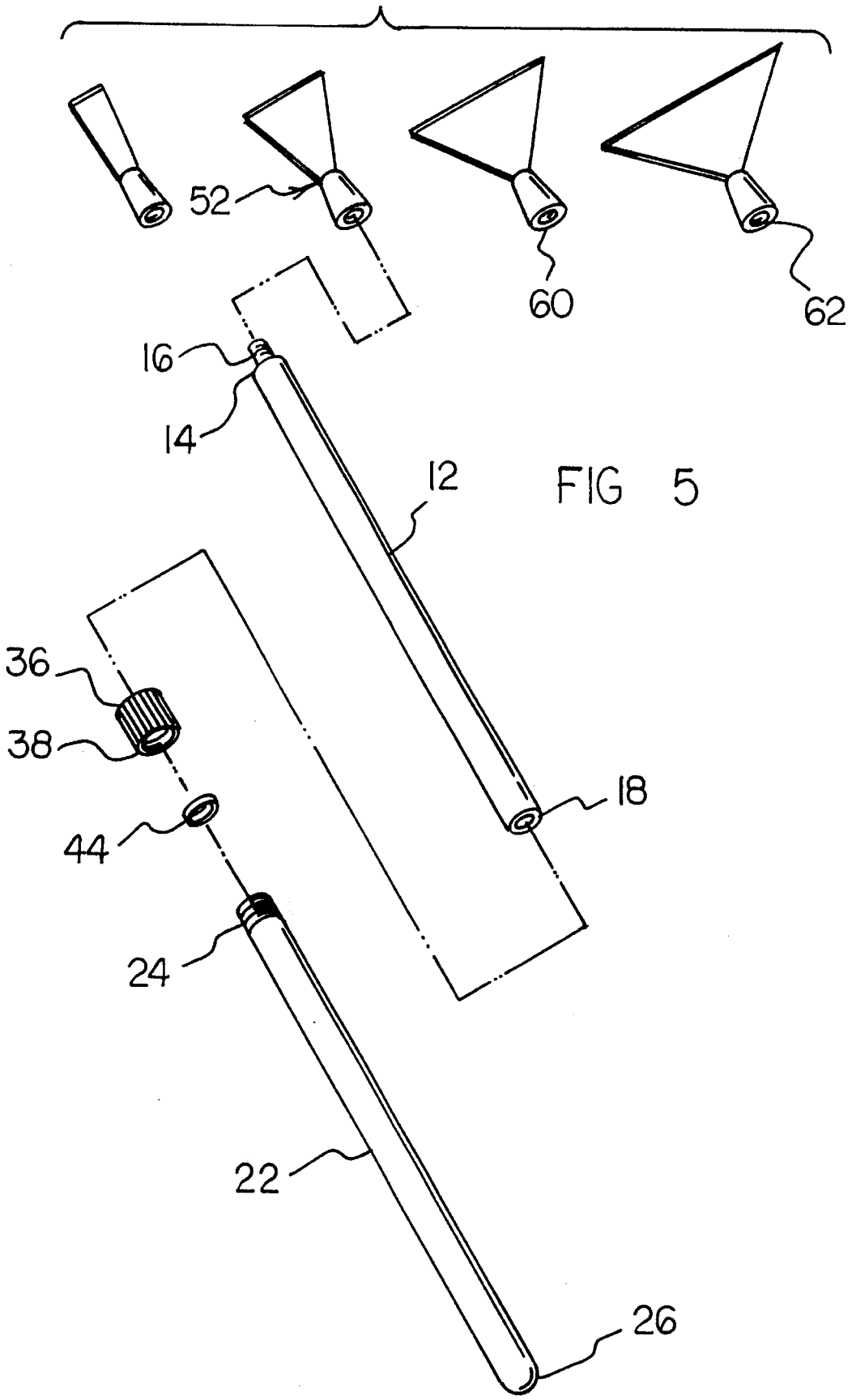
FIG. 5 is an exploded view of the present invention showing a first scrapper embodiment.

Furthermore, a scrapper component 52 is provided. As shown in the Figures, the scrapper component resides along an axis defined by the handles. The scraper component has a cylindrical support handle 54 with a triangular portion 56 that has a blade edge 58. The scraper component has a length of about eight inches, with the triangular portion being sixty percent of the length. The triangular portion has a blade width between two to five inches as shown in FIG. 5. The triangular portion is formed of metal with the blade edge being tapered. The tapering of the blade's edge improves the blade's scrapping ability. The blade edge is rigid for scraping a surface above the arm reach of a user and for scrapping a surface below the arm reach of the user. Increasing the reach height of the scrapper by using the telescopic handle will reduce strain to the back of the user. Reduced back strain allows the user to work longer hours.

Lastly, the support handle 54 has a decreasing exterior diameter decreasing from a back end 60 to the triangular portion. The support handle has an internal threaded portion 62. The support handle has a length of about two inches with an internal threaded portion capable of threadable coupling with the threaded projection 16 of the first upper end 14 of the first handle 12. The support handle is coupled to the first handle when the first handle is secured within the second handle 22 by the coupling nut 34.

The present invention is a telescopic scraper tool that has a first handle and a second handle that is capable of receiving the first handle therein. The telescopic handle is formed when the handles are coupled together and locked in place by a coupling nut. At the end of the first handle has a scrapper component. The scrapper component has a blade edge for scraping. The telescopic scrapping tool can be adjusted to various heights ranging from two feet to four feet. The scrapper tool can be used by user when scrapping overhead or when scrapping near the feet of the user. With the scrapper tool the user is able to set the length of the handle according to his or her needs. The scrapper may also be used without the handle if necessary. The telescopic scrapper tool will make it easier for a worker to scrap paint, plaster walls and scrap wood floors, without bending and reaching. Additionally, by using the telescopic scrapper the user will not have to use a stepladder that may cause additional undue stress to the lower back muscles, and other muscles. Generally, the telescopic scrapper makes it easy for the user to reach hard places.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved telescopic scraper tool for increasing the reaching ability of the user comprising in combination;

a first cylindrical handle having a first upper end with a threaded projection and a first lower end, the threaded projection having a diameter of ⅝ inch, the first handle having a diameter of 1 inch and a length of about 24½ inches including the threaded projection, the threaded projection being cylindrical in shape and having a length about 6.5 percent of the length of the handle;

a second cylindrical handle having a second upper end being threaded and a rounded second end being closed, the second upper end having an aperture therein, the aperture extends to the second rounded end, the second handle having a diameter of about 1¼ inch for slidable receipt of the first handle therein, the second handle having a length of about 23¼ inches, the second cylindrical handle capable of receiving 95 percent of the length of the first handle to form a telescopic handle, the telescopic handle capable of having an increasing and decreasing the length of about between 2 to 4 feet;

a cylindrical coupling nut having a top end and a bottom end with an exterior surface area therebetween, the top end having an over hang for allowing a ring to be captured within the coupling nut, the surface area having a plurality of rectangular raised portions covering a circumference of the surface area, the raised portions being capable of increasing the gripping friction between fingers and the nut, the nut being capable of slidable receipt of the first handle therethrough, the nut being capable of threadable coupling with the second upper end of the second handle when the first handle being positioned within the second handle, and the second upper end resting upon the ring within the nut, the nut being capable of locking the telescopic handle in position;

a scrapper component residing along an axis defined by the handles and having a cylindrical support handle with a triangular portion having a blade edge, the scrapper component having a length of about 8 inches with the triangular portion being 60 percent of the length, the triangular portion having a blade width being between 2 to 5 inches, the blade edge being ridge for scrapping a surface above the arm reach of a user, the blade edge for scrapping a surface below the arm reach of the user; and the support handle having a decreasing exterior diameter decreasing from a back end to the triangular portion, and an internal threaded portion, the support handle having a length of about 2 inches with the internal threaded portion capable of threadable coupling with the threaded projection of the first upper end of the first handle, the support handle being coupled to the first handle when the first handle being secured within the second handle by the coupling nut.

* * * * *